US006977625B1

(12) United States Patent
Zhou

(10) Patent No.: US 6,977,625 B1
(45) Date of Patent: Dec. 20, 2005

(54) ANTENNA HAVING REFLECTOR PANEL

(75) Inventor: Doung Sheng Zhou, Tauyuan Hsien (TW)

(73) Assignee: Joymax Electronics Co., Ltd., Tauyuan Hsien (TW)

( * ) Notice: Subject to any disclaimer, the term of this patent is extended or adjusted under 35 U.S.C. 154(b) by 0 days.

(21) Appl. No.: 10/864,741

(22) Filed: Jun. 9, 2004

(51) Int. Cl.[7] ..... H01Q 21/00
(52) U.S. Cl. ..... 343/835; 343/840; 343/912
(58) Field of Search ..... 343/835, 840, 343/912, 795; H01Q 21/00

(56) References Cited

U.S. PATENT DOCUMENTS 5,550,554 A 8/1996 Erkocevic ..... 343/828
5,563,613 A 10/1996 Schroeder et al. ... 343/700 MS
5,563,616 A 10/1996 Dempsey et al. ..... 343/753
5,617,107 A * 4/1997 Fleming ..... 343/704
5,699,072 A * 12/1997 Tokuda et al. ..... 343/786
6,127,987 A * 10/2000 Maruyama et al. ..... 343/835

* cited by examiner

*Primary Examiner*—Hoang V. Nguyen
*Assistant Examiner*—Binh Van Ho
(74) *Attorney, Agent, or Firm*—Charles E. Baxley

(57) ABSTRACT

An antenna includes a reflector panel having an inner concave surface and an outer convex surface, a circuit board having two antenna members directed toward different directions and having a terminal coupled to a cable device. The circuit board is received in the concave surface of the reflector panel, and the concave surface of the reflector panel may be used to reflect or to concentrate signals to and from the circuit board. It is preferable that the antenna members are disposed on two opposite surfaces of the circuit board, and directed toward opposite directions. A casing may support the circuit board, and has a channel to receive the circuit board.

10 Claims, 4 Drawing Sheets

ANTENNA HAVING REFLECTOR PANEL

BACKGROUND OF THE INVENTION

1. Field of the Invention

The present invention relates to an antenna, and more particularly to an antenna having a signal reflector panel to suitably reflect and/or concentrate the signals emitted from or receiving into the antenna.

2. Description of the Prior Art

Various kinds of typical antenna devices have been developed and provided for attaching to electric facilities, computer facilities, or the like, and comprise one or more antenna members disposed or applied on a board, for emitting or receiving signals.

For example, U.S. Pat. No. 5,550,554 to Erkocevic, U.S. Pat. No. 5,563,613 to Schroeder et al., and U.S. Pat. No. 5,563,616 to Dempsey et al. disclose three of the typical antenna devices each also comprising one or more antenna members disposed or applied on a board, for emitting or receiving signals.

However, the antenna members normally include a planar structure and disposed or applied on a planar board, such that the signals emitted from the antenna may not be suitably concentrated and may not be suitably emitted out to the other electric facilities, computer facilities, or the like.

Similarly, the antenna also may not be used to suitably concentrate and receive the signals emitted from the other electric facilities, computer facilities, or the like.

The present invention has arisen to mitigate and/or obviate the afore-described disadvantages of the conventional antennas.

SUMMARY OF THE INVENTION

The primary objective of the present invention is to provide an antenna including a signal reflector panel to suitably reflect and/or concentrate the signals emitted from or receiving into the antenna.

In accordance with one aspect of the invention, there is provided an antenna comprising a reflector panel including an inner concave surface and an outer convex surface, a circuit board including two antenna members provided thereon and directed toward different directions, and each of the antenna members including a terminal extended therefrom, and a cable device electrically coupled to the terminals of the antenna members. The circuit board is received in the concave surface of the reflector panel, and the concave surface of the reflector panel is provided for reflecting signals to and from the circuit board.

The circuit board includes two opposite surfaces having the antenna members provided thereon respectively, and directed toward different direction. The antenna members are directed toward opposite directions. The terminals of the antenna members are perpendicular to the antenna members respectively. The reflector panel includes an orifice formed therein for receiving the cable device.

A casing is further provided to support the circuit board, and includes a channel formed therein, to receive the circuit board in the channel of the casing. The casing includes a plate extended therefrom, the reflector panel is attached onto the plate.

The plate is curved having a convex surface provided thereon, the concave surface of the reflector panel is engaged onto the convex surface of the plate. The plate includes a peripheral flange extended from the convex surface thereof, to form a recess therein, and to receive and to anchor the reflector panel in the recess of the plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
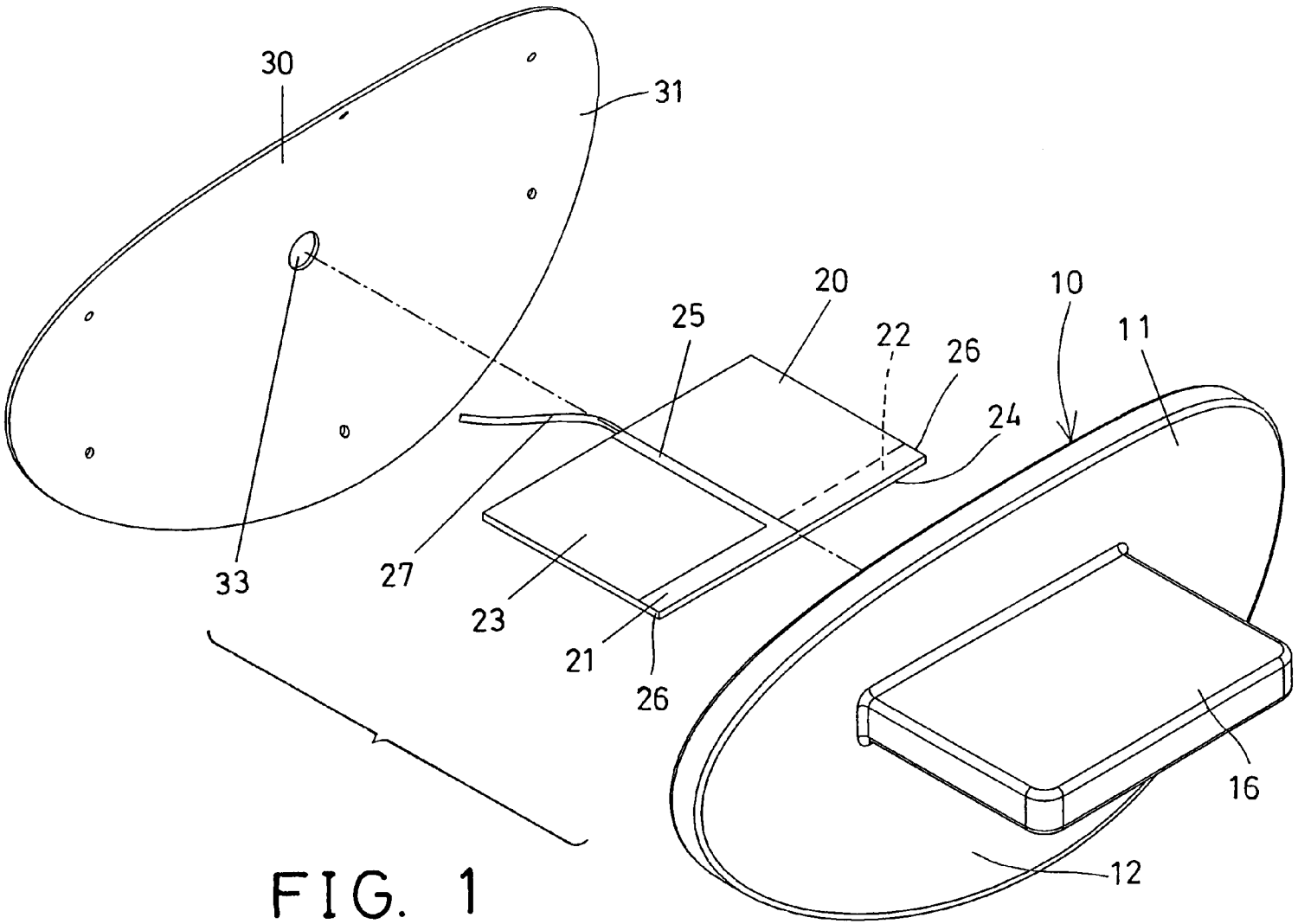
FIG. 1 is an exploded view of an antenna in accordance with the present invention.
Figure 3:
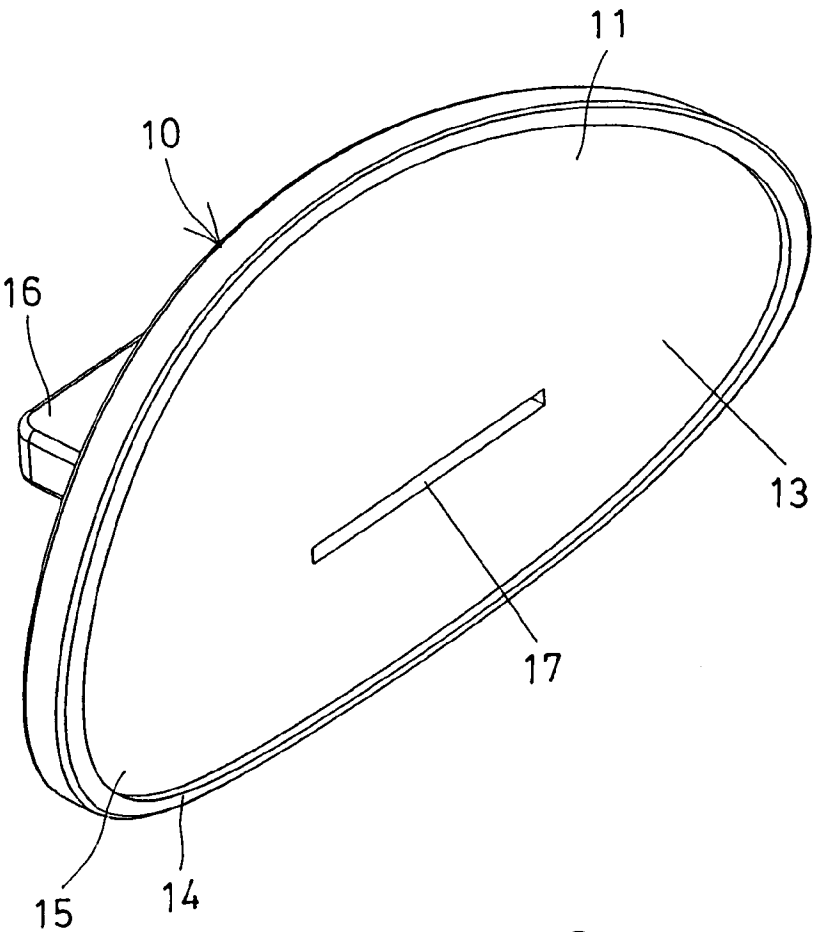
FIG. 3 is a perspective view of a housing of the antenna.
Figure 2:
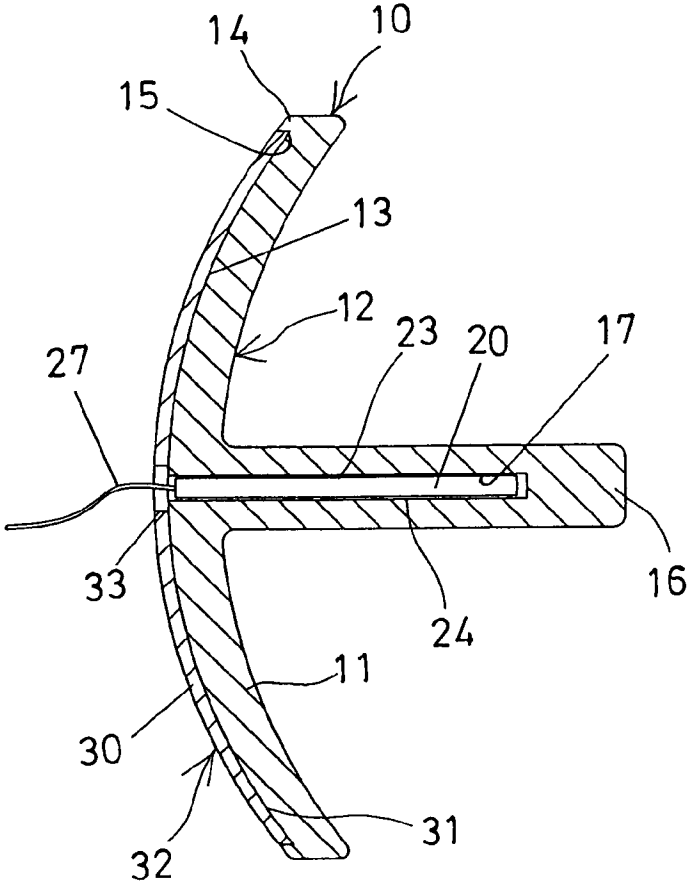
FIG. 2 is a cross sectional view of the antenna.

Referring to the drawings, and initially to FIGS. 1–3, an antenna in accordance with the present invention comprises a housing 10 including a curved plate 11 having a concave surface 12 formed or provided in the inner portion thereof, and having a convex surface 13 formed or provided in the outer portion thereof, and having a peripheral flange 14 extended out from the convex surface 13, to form or define a recess 15 therein.

The housing 10 further includes a casing 16 extended forwardly from the concave surface 12 of the curved plate 11, and substantially perpendicular to the curved plate 11 (FIG. 2), and having a channel 17 formed therein, and communicating with the recess 15 of the curved plate 11, for receiving a circuit board 20, such as a printed circuit board 20 therein.

The circuit board 20 includes two antenna members 21, 22 applied or printed onto or secured to two opposite surfaces 23, 24 thereof respectively, and directed toward different or opposite directions, and each having a conductor or terminal 25 extended therefrom and/or perpendicular to the antenna members 21, 22 respectively, for electrically coupling to a cable device 27. Each of the antenna members 21, 22 may further include another conductor or terminal extended therefrom (not shown), for electrically coupling to the cable device 27, for grounding purposes.

A curved signal reflector panel 30 is further provided and engaged or secured into the recess 15 of the curved plate 11, and includes a concave surface 31 formed or provided in the inner portion thereof, for engaging onto the convex surface 13 of the curved plate 11, and for allowing the reflector panel 30 to be anchored or secured to the curved plate 11. The reflector panel 30 also includes a convex outer surface 32, and includes an orifice 33 formed in the center portion thereof for receiving the cable device 27 (FIGS. 2, 4, 5).

Figure 4:
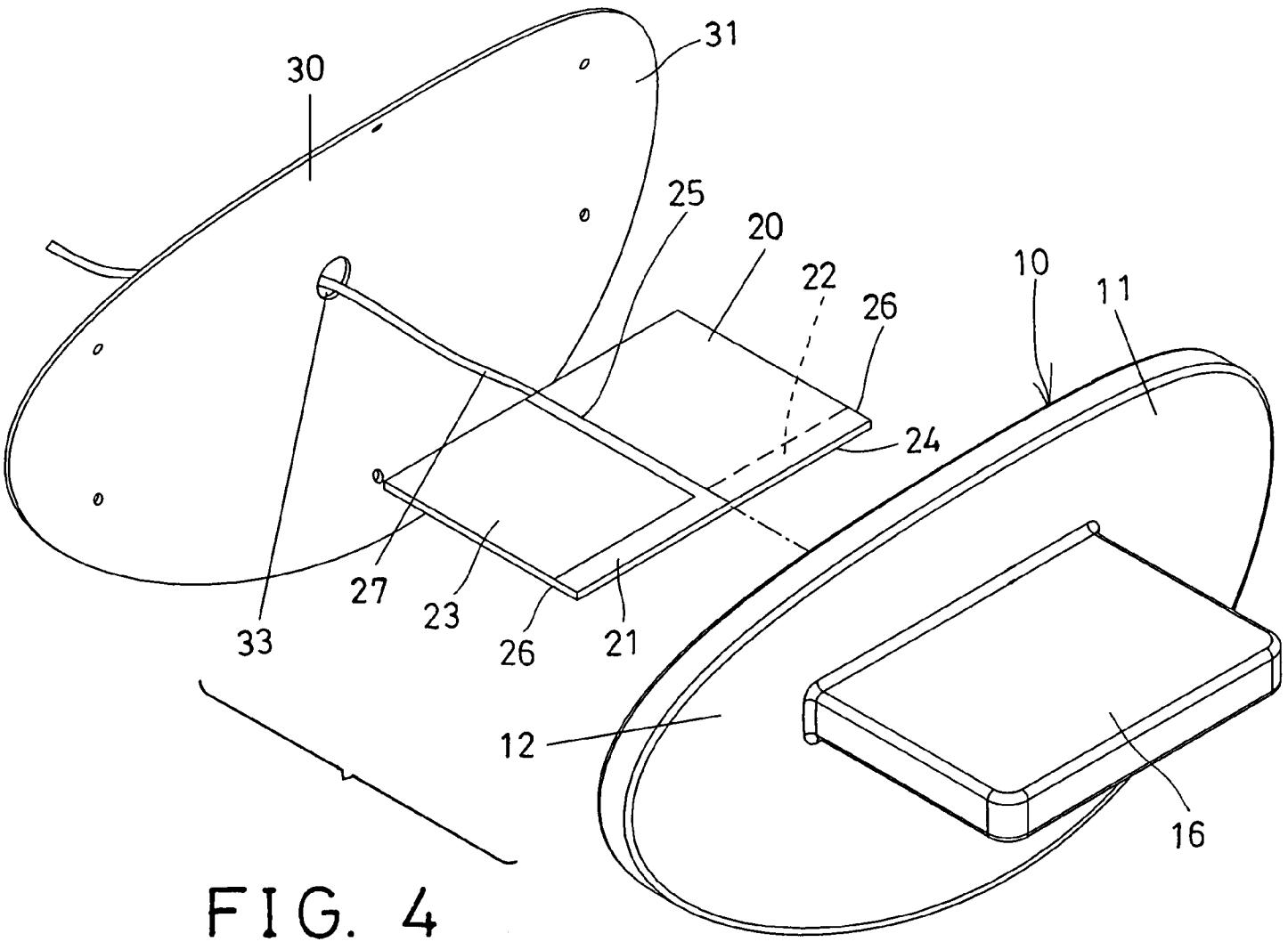
FIG. 4 is an exploded view similar to FIG. 1, illustrating the assembling operation of the antenna.

As shown in FIG. 4, when assembling the antenna, the cable device 27 may first be engaged through the orifice 33 of the reflector panel 30, and the circuit board 20 may then be engaged into the channel 17 of the casing 16 or of the housing 10. The reflector panel 30 may then be engaged and secured into the recess 15 of the curved plate 11, to shield and to stably retain the circuit board 20 within the channel 17 of the casing 16 or of the housing 10.

When the circuit board 20 is retained within the channel 17 of the casing 16 or of the housing 10, the circuit board 20 may also be supported and positioned in a position substantially perpendicular to the curved plate 11 and the reflector panel 30 (FIGS. 2, 5), and/or received in the concave surface 12 of the curved plate 11 or in the concave surface 31 of the reflector panel 30, for allowing the signals 29 emitted from the antenna members 21, 22 to be suitably reflected and/or concentrated by the reflector panel 30.

Figure 5:
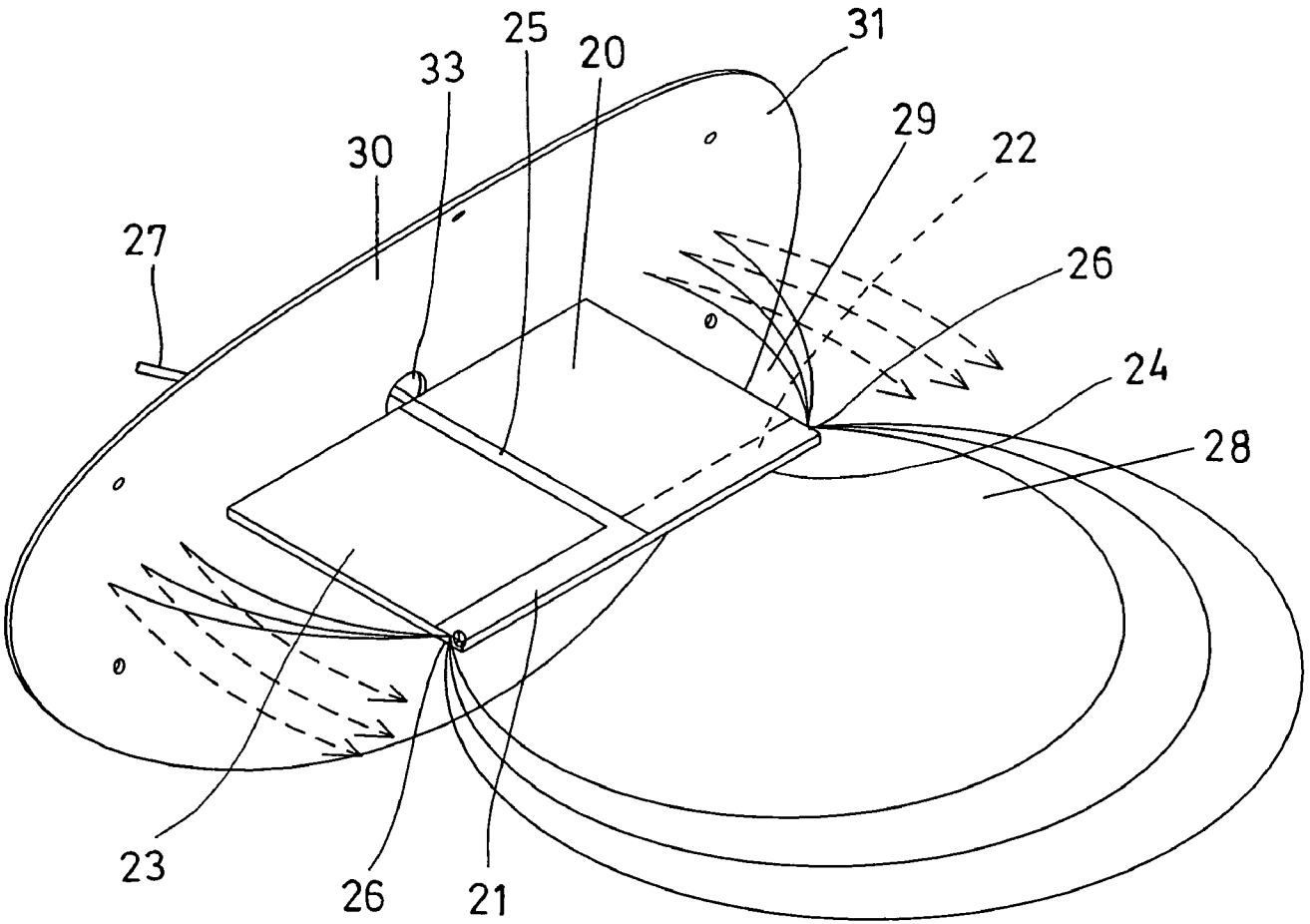
FIG. 5 is a perspective view of the antenna, in which the outer housing has been removed, for illustrating the operation of the antenna.

In operation, as shown in FIG. 5, the signals 28 emitted forwardly from the antenna members 21, 22 may be suitably emitted out of the circuit board 20, and may thus be suitably emitted out to the other electric facilities, computer facilities, or the like. The other signals 29 emitted rearwardly from the antenna members 21, 22 or emitted toward the reflector panel 30, may be suitably reflected and/or concentrated by the reflector panel 30, for allowing the signals 29 to be suitably emitted out to the other electric facilities, computer facilities, or the like.

On the contrary, the reflector panel 30 may also be used to suitably reflect and/or concentrate signals, to allow the signals to be suitably received by the antenna members 21, 22, and thus for allowing the antenna members 21, 22 to suitably receive signals from the other electric facilities, computer facilities, or the like.

Accordingly, the antenna in accordance with the present invention includes a signal reflector panel to suitably reflect and/or concentrate the signals emitted from or receiving into the antenna.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An antenna comprising:

a reflector panel including an inner concave surface and an outer convex surface, a circuit board including two antenna members provided thereon and directed toward different directions, and each of said antenna members including a terminal extended therefrom, and a cable device electrically coupled to said terminals of said antenna members, and said circuit board being received in said concave surface of said reflector panel, and said concave surface of said reflector panel being provided for reflecting signals to and from said circuit board.

2. The antenna as claimed in claim 1, wherein said circuit board includes two opposite surfaces having said antenna members provided thereon respectively, and directed toward different direction.

3. The antenna as claimed in claim 1, wherein said antenna members are directed toward opposite directions.

4. The antenna as claimed in claim 1, wherein said terminals of said antenna members are perpendicular to said antenna members respectively.

5. The antenna as claimed in claim 1, wherein said reflector panel includes an orifice formed therein for receiving said cable device.

6. The antenna as claimed in claim 1 further comprising a casing to support said circuit board.

7. The antenna as claimed in claim 6, wherein said casing includes a channel formed therein, to receive said circuit board in said channel of said casing.

8. The antenna as claimed in claim 6, wherein said casing includes a plate extended therefrom, said reflector panel is attached onto said plate.

9. The antenna as claimed in claim 8, wherein said plate is curved having a convex surface provided thereon, said concave surface of said reflector panel is engaged onto said convex surface of said plate.

10. The antenna as claimed in claim 9, wherein said plate includes a peripheral flange extended from said convex surface thereof, to form a recess therein, and to receive and to anchor said reflector panel in said recess of said plate.

* * * * *